US009789486B1

(12) United States Patent
Juers et al.

(10) Patent No.: US 9,789,486 B1
(45) Date of Patent: Oct. 17, 2017

(54) SYSTEM TO CONTROL THE LOCAL HUMIDITY OF A SAMPLE DURING MANIPULATION UNDER A MICROSCOPE AND SUBSEQUENT TRANSFER TO AN ANALYTICAL INSTRUMENT

(71) Applicant: Whitman College, Walla Walla, WA (US)

(72) Inventors: Douglas H Juers, Walla Walla, CA (US); Christopher A Farley, Toppenish, WA (US)

(73) Assignee: Whitman College, Walla Walla, WA (US)

( * ) Notice: Subject to any disclaimer, the term of this patent is extended or adjusted under 35 U.S.C. 154(b) by 208 days.

(21) Appl. No.: 14/744,901

(22) Filed: Jun. 19, 2015

Related U.S. Application Data

(60) Provisional application No. 62/015,186, filed on Jun. 20, 2014.

(51) Int. Cl.
*B01L 9/00* (2006.01)
*B01L 3/00* (2006.01)

(52) U.S. Cl.
CPC ..... *B01L 9/00* (2013.01); *B01L 3/561* (2013.01); *B01L 2200/026* (2013.01); *B01L 2300/042* (2013.01); *B01L 2300/0609* (2013.01); *B01L 2300/0858* (2013.01); *B01L 2300/10* (2013.01); *B01L 2300/12* (2013.01); *B01L 2300/1883* (2013.01)

(58) Field of Classification Search
CPC ..... B01L 9/00; B01L 3/561; B01L 2300/12; B01L 2300/042; B01L 2300/0609; B01L 2200/026; B01L 2300/1883; B01L 2300/0858; B01L 2300/10
See application file for complete search history.

(56) References Cited

PUBLICATIONS

Seiki Baba et al., "Humidity control and hydrophilic glue coating applied to mounted protein crystals improves X-ray diffraction experiments", Acta Crystallographica Section D, Biological Crystallography, ISSN 0907-4449, Acta Cryst. (2013), D69, pp. 1839-1849.

Reiner Kiefersauer et al., "A novel free-mounting system for protein crystals: transformation and improvement of diffraction power by accurately controlled humidity changes", Journal of Applied Crystallography, ISSN 0021-8898, Appl. Cryst. (2000), 33, pp. 1223-1230.

Juan Sanchez-Weatherby et al., "Improving diffraction by humidity control: a novel device compatible with X-ray beamlines", Acta Crystallographica Section D, Biological Crystallography, ISSN 0907-4449, Acta Cryst. (2009), D65, pp. 1237-1246.

(Continued)

*Primary Examiner* — Sally Merkling
(74) *Attorney, Agent, or Firm* — Staniford Tomita LLP

(57) ABSTRACT

An adaptor to help control local humidity of a sample includes a delivery port having a first side and a second side, opposite the first side. The first side includes an opening that is to be connected to a fluid source. The second side includes a sidewall. A platform extends from the sidewall. A vial holder is connected to the sidewall. A portion of the sidewall is absent above the platform to allow manipulation of the sample.

11 Claims, 15 Drawing Sheets

(56) References Cited

PUBLICATIONS

Tove Sjogren et al., "Protein crystallography in a vapour stream: data collection, reaction initiation and intermediate trapping in naked hydrated protein crystals", Journal of Applied Crystallography, ISSN 0021-8898, Appl. Cryst. (2002) 35, pp. 113-116.

Matthew J. Wheeler et al., "Measurement of the equilibrium relative humidity for common precipitant concentrations: facilitating controlled dehydration experiments", Acta Crystallographica Section F, Structural Biology and Crystallization Communication, ISSN 1744-3091, Acta Cryst. (2012) F68, pp. 111-114.

SYSTEM TO CONTROL THE LOCAL HUMIDITY OF A SAMPLE DURING MANIPULATION UNDER A MICROSCOPE AND SUBSEQUENT TRANSFER TO AN ANALYTICAL INSTRUMENT

CROSS-REFERENCE TO RELATED APPLICATIONS

This patent application claims the benefit of U.S. provisional patent application 62/015,186, filed Jun. 20, 2014, which is incorporated by reference along with all other references cited in this application.

GOVERNMENT INTEREST

This invention was made with government support under R15-GM090248 awarded by the National Institutes of Health. The government has certain rights in the invention.

BACKGROUND

The present invention relates to systems and techniques for controlling the local humidity of a sample, in particular in the field of macromolecular crystallography for the purpose of manipulating macromolecular crystals and for transferring macromolecular crystals from their growth wells to an X-ray diffractometer.

It is common for small (i.e. <1 mm) samples to be manipulated under a stereomicroscope (dissection microscope) for a variety of purposes, such as sample conditioning and sample mounting. A specific example concerns the manipulation of macromolecular crystals, which are typically grown in well plates (24 to 384 wells per plate). Each well is prepared with a solution of the macromolecule of interest and is sealed. Upon equilibration, the well may produce a crystal of the macromolecule. For analysis, the wells are usually opened to allow for mounting of the crystal and transfer to an X-ray diffractometer, using a variety of methods. In some cases, crystals must also be pretreated with solutions prior to mounting for cryoprotection or to provide a ligand of interest. These manipulations require exposure of the crystalline sample to the ambient environment. Such exposure of previously isolated samples to the ambient environment is common in many fields. For samples sensitive to ambient conditions (e.g. humidity and temperature), the exposure during manipulation under the microscope can be damaging to the sample.

Environmental chambers designed to be placed on a microscope are commercially available (e.g. chambers for live-cell imaging in fluorescent confocal microscopes and chambers for atomic force microscopy). However, these chambers are designed to house a sample and then control the environment of the sample during imaging. They cannot be effectively implemented for the types of sample manipulations under a stereomicroscope described above. Other related commercial products allowing for sample manipulation in a controlled environment are gloveboxes. However, these are large, expensive, and awkward, and therefore impractical for the manipulations described above. There is thus a need for a simple, compact, and quickly responsive approach for controlling the environmental conditions of macromolecular crystals and other similarly sized and sensitive samples during their manipulation under stereomicroscopes, allowing for high throughput and maximum dexterity of the researcher.

BRIEF SUMMARY OF THE INVENTION

In a specific embodiment, there is an adaptor to help control local humidity of a sample. The adaptor includes a delivery port having a first side and a second side, opposite the first side. The first side includes an opening that is to be connected to a fluid source. The second side includes a sidewall. A platform extends from the sidewall. A vial holder is connected to the sidewall. A portion of the sidewall is absent above the platform to allow manipulation of the sample.

In another specific embodiment, there is an adaptor device to hold a vial. The adaptor device includes a body portion including an input port at a first end of the body portion, a platform at a second end of the body portion, opposite the first end, a fluid passageway extending from the input port towards the platform, a lip extending from a first edge of the platform, a first sidewall extending from a second edge of the platform, opposite the first edge. The first sidewall extends at most partially around the fluid passageway. There is a slot extending from an edge of the first sidewall towards the input port that receives an upper portion of the vial. The slot includes a U-shape and each of a first set of edges of the slot and a second set of edges of the slot, opposite the first set of edges, is rounded. There is a vial holder portion, connected to the first sidewall of the body portion, the vial holder portion includes a base, facing the slot, and includes a first side, and a second side, opposite the first side. The first side includes a first cavity that receives a bottom portion of the vial, and the second side includes a second cavity that receives a magnet. The magnet imposes a force on the bottom portion of the vial in a direction from the first side to the second side to removably secure the vial against the base. There is a second sidewall extending from the base to the first sidewall. The second sidewall extends at most partially around the base. An angle between the platform and an axis passing through the base and the slot is about 20 degrees. A path of the humid airflow is from the input port, through the fluid passageway, past the upper portion of the vial, and above the platform. A transition between the platform and the input port is tapered. A material of the adaptor includes a transparent plastic.

In another specific embodiment, systems and techniques are provided for preserving the humidity of microscopic samples during manipulation, harvesting and mounting while under a microscope and subsequent transfer to an analytical instrument. In a specific embodiment, the approach includes three separate steps. A first step includes manipulation of the sample under a controllable humid flow using a specialized adaptor. A second step includes mounting of the sample in a vial, which preserves the humidity of the sample during transport away from the microscope. A third step includes equilibration of the sample in the vial and subsequent transfer to the instrument to be used for sample analysis. The approach can be used for manipulation and mounting of protein crystals on an X-ray diffractometer and parts can be generally applicable to samples sensitive to ambient humidity. Each phase is described separately below.

Other objects, features, and advantages will become apparent upon consideration of the following detailed description and the accompanying drawings, in which like reference designations represent like features throughout the figures.

DETAILED DESCRIPTION

Most macromolecular crystals are sensitive to both ambient humidity and in some cases temperature. However, manipulations of crystals are normally done in ambient conditions. Such manipulations include transfer of crystals to cryosolutions, equilibration of crystals to cryosolutions, surgically isolating single crystals from precipitates and crystal clusters, mounting crystals in capillary tubes, mounting crystals in loops for cryocrystallography, and wicking extra solution away from the crystal to reduce background X-ray scatter. It has been shown that brief exposure of crystals to low ambient humidity during crystal mounting reduces unit cell volumes due to dehydration (Farley & Juers, 2014a). This impacts the effectiveness of comparing X-ray data between different crystals that have suffered different amounts of dehydration. More problematic, depending on exposure length and the ambient humidity level, exposure can significantly damage the crystal, eliminating useful diffraction and rendering the crystal useless for structure determination. Wicking solution away from crystals in particular increases the sensitivity of the crystals to low humidity conditions. Despite these known issues with manipulating macromolecular crystals under ambient conditions, current practice typically addresses these concerns simply by carrying the manipulations out as fast as possible, and by replenishing the solution supporting the crystal as it evaporates.

Step 1. Manipulation of Samples Under a Humid Flow.

Figure 1:
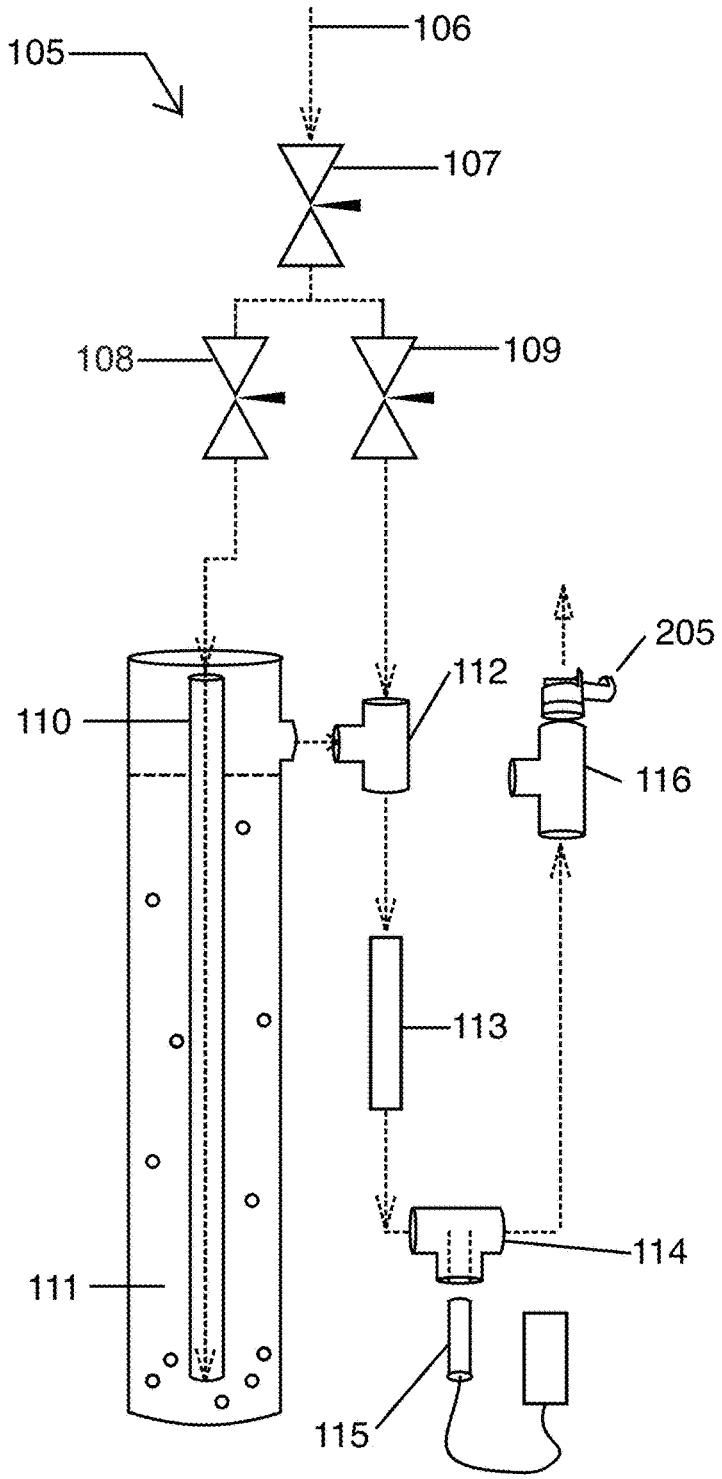
FIG. 1 shows an example of a humidity control apparatus.

FIG. 1 shows an example of a humidity control apparatus 105 as described in "Farley, C, Burks, G, Siegert, T, Juers, D H. Improved Reproducibility of Cell Parameters in Macromolecular Cryocrystallography by Limiting Dehydration During Crystal Mounting. Acta crystallographica, Section D.2111-2124," which is incorporated by reference along with "Farley, C & Juers, D H. Improving Cell Parameter Reproducibility in Macromolecular Cryocrystallography". Poster. Biophysical Society Annual Meeting, Feb. 16, 2014," (Farley & Juers, 2014a) and all other references cited in this patent application.

Pressure regulated house air 106 is divided into dry and humid paths. Flow is controlled via three needle valves 107,108,109 (either manual or electronic). The humid path flows through a narrow tube 110 exiting at the bottom of a water reservoir 111. The air bubbles up through the water, becoming humidified, and then recombines and mixes with the dry flow in a chamber 112. The flow rate is measured with an inline ball flowmeter 113. The humidity is measured in a chamber 114 with a humidity probe 115 previously calibrated against standard salt solutions. The humid air exits the humidification system via a tube/connector 116 that couples the controllable humid flow to the adaptor 205.

Dry and humid air can be combined to achieve a controllable humid flow. In a specific embodiment, systems and techniques are provided that allow the humid flow apparatus described here to achieve high flow rates. Previously described devices for maintaining the humidity of macromolecular crystalline samples have been targeted at room temperature data collection, and focus on finely controlled and stable humidity over a small area (Kiefersauer et al., 2000; Sjogren et al., 2002; Sanchez-Weatherby et al., 2009; Baba et al., 2013).

Here, the goal is to humidify a larger area—covering one or two coverslips and a vial—so it is desirable that the flow rate be higher. A coverslip or cover glass is a thin flat piece of transparent material, usually square or rectangular, and generally about 20 millimeters (mm) wide and a fraction of a millimeter thick, that is placed over objects for viewing with a microscope. Additionally, in a specific embodiment, since the humid flow is used for crystal mounting rather than data collection, long-term stability is less important. In this specific embodiment, the humidity control apparatus, which divides house air (relative humidity (RH) of about 10 percent) into two paths, humidifies one, and then recombines the two paths to yield a controllable humid flow, is built from off-the-shelf components (FIG. 1).

In a specific embodiment, the water reservoir, humidity probe chamber, and output port are all fashioned primarily from schedule 40 PVC pipe and fittings. In this specific embodiment, the pipe and fittings were obtained from Dura Plastic Products of Beaumont, Calif., USA and Spears Manufacturing, of Auburn, Wash., USA; the transparent or clear pipe was obtained from US Plastic Corp., of Lima, Ohio, USA. The water reservoir included a 1.2-2.4 m (4-8') long pipe (nominal diameter 5.1 or 7.6 cm (2 or 3")) with cap (bottom) and tee or cross (top). The humidity probe chamber 114 included a reducing tee (2.54 cm×2.54 cm×1.27 cm (1"×1"×½")) output port 116: reducing tee ((3.81 cm×3.81 cm×2.54 cm (1½"×1½"×1")).

Topping the reservoir with a cross provides an extra port that can be used to replenish the water. Reducer bushings couple the chambers and output port to tubing (either one stage via slip/thread (1.27 cm (½")) or two stage, which is more modular, via outer slip/slip(2.54 cm (1"))-slip(2.54 cm (1"))/thread(1.27 cm (½"))).

For coupling to the air path in the reservoir, a specialized connector was made using two Dura Plastics pieces glued together: slip(5.08 cm (2"))/slip(2.54 cm (1")) and slip(1.91 cm (¾"))/thread(1.27 cm (½")) with a slip(2.54 cm (1"))/thread(1.27 cm (½")) friction fitted at the very top to accept a tubing connector. The system is plumbed mainly with polyvinyl tubing (ID=6.35 mm (¼"), OD=9.53 mm (⅜"), pressure limit=55 psi), brass needle valves with compression fittings, brass hose barbs and quick connect fittings which were obtained from Watts of North Andover, Mass., USA.

For flexibility, silicone tubing is used between the humidity probe chamber 114 and the output port 116. The flow rate is monitored with an inline floating ball flowmeter (provided by Gilmont Instruments of Barrington, Ill., USA), and the humidity is monitored with a humidity/temperature probe (HH314, provided by Omega Engineering of Stamford, Conn., USA) coupled to the humidity probe chamber with a section of a 15 mL centrifuge tube.

The humidification efficacy and sustainability depend on the details of the water reservoir and the delivery of air at the bottom of the reservoir. A specific embodiment includes a 2.4 m (4') long 5.08 cm (2") diameter pipe for the reservoir and 2.4 m (4') long 1.27 cm (½") diameter pipe terminated in a sprinkler head for the air path, yielding a maximum humidity of about 95 percent for intermittent usage. With continuous usage at the required flow rate (10 L/m), the maximum humidity dropped to below 90 percent in an hour, due to a decrease in the efficacy of humidification. In another specific embodiment, the configuration includes a 2.4 m (4') long 7.62 cm (3") diameter pipe for the reservoir, a 1 m (39") column of water, and a flexible hose terminating at the bottom of the water reservoir in an aquarium airstone (1.9 cm×1.9 cm 5.08 cm (¾"×¾"×2")) for the air path, which yields a maximum RH of about 95 percent and a greater than 2 hour drop to 90 percent. In another specific embodiment, the configuration includes a 3.6 m (6') long 7.62 cm (3") diameter pipe. This specific embodiment can yield a maximum RH of about 99 percent RH and a greater than 2 hour drop to 95 percent. Although some specific dimensions, angles, and geometries are shown and described in this patent application, one of skill in the art would understand that there can be other dimensions, angles, and geometries so as to provide the appropriate humidity, flow, and other desired characteristics and also as appropriate for the specific sample and size of the sample being analyzed.

As discussed above, a specific embodiment of the humidity controller utilizes a large water reservoir (3.6 m (6') long, 7.62 cm (3") diameter tube). In some cases, the controller can be cumbersome and is generally fixed once it is full of water. Thus, another specific embodiment provides for a more portable humid air source. In this specific embodiment, a more portable humidity controller includes a portable room humidifier coupled to a fan to deliver the humid branch entering at chamber 112 in FIG. 1. This allows for easy movement of the humidity controller/adaptor between different microscopes in the same room or between rooms.

Humidification efficacy can also be maintained by temperature controlling the water in the reservoir. Over time the water tends to cool, due to the evaporation involved in humidifying the air. The cooling reduces the efficacy of the humidification. Temperature controlling the water with a small temperature controlled heater maintains the absolute humidity level of the water exiting the humidification chamber. Thus, another specific embodiment providing for a more portable humid air source includes a smaller reservoir that is temperature controlled. This allows for easy movement of the humidity controller/adaptor between different microscopes in the same room or between rooms.

Figure 2A:
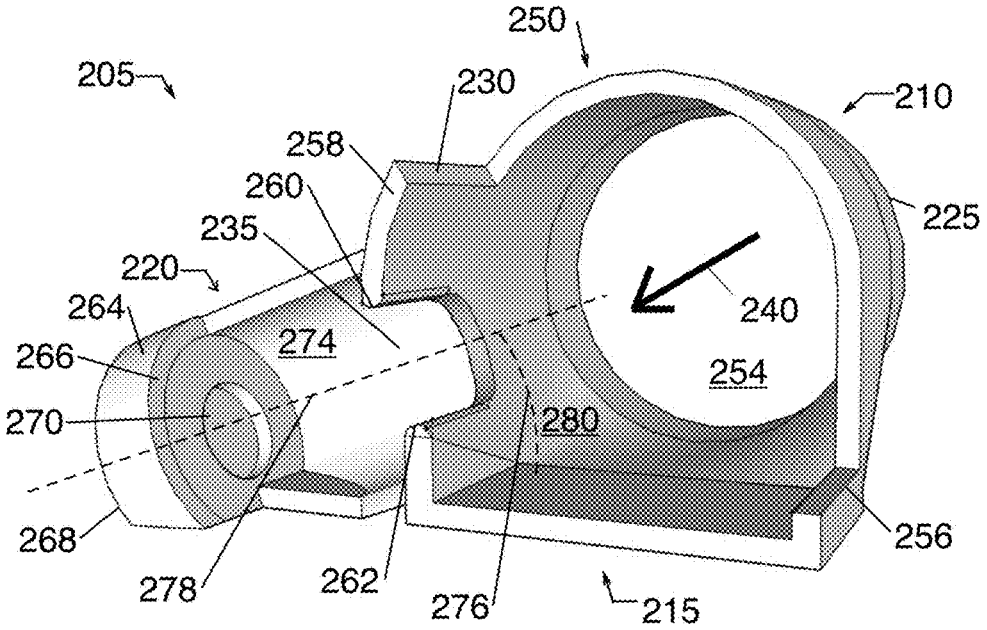
FIG. 2A shows a front view of a first embodiment of an adaptor for sample manipulation under humid airflow.
Figure 2B:
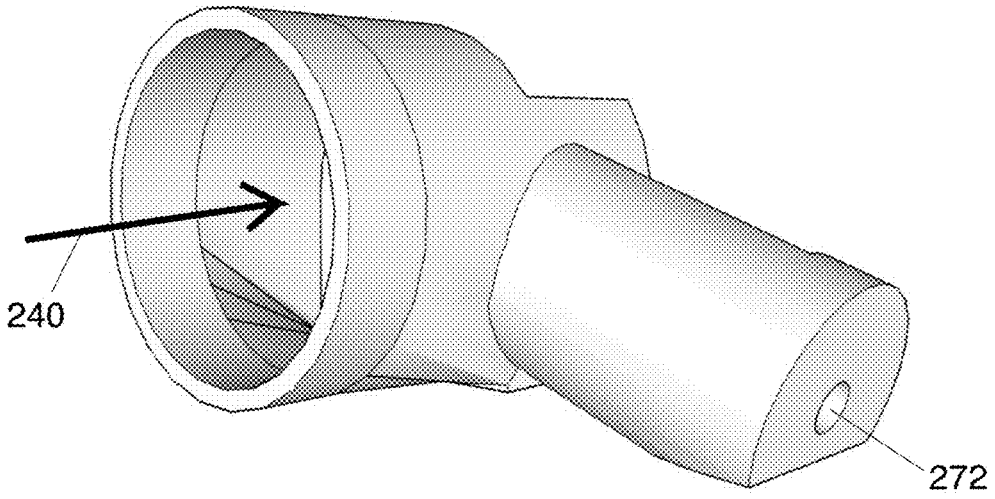
FIG. 2B shows a rear view of the first embodiment of the adaptor shown in FIG. 2A.

FIGS. 2A-B show a specific embodiment of an adaptor 205 for sample manipulation under humid airflow. FIG. 2A shows a front view of the adaptor. FIG. 2B shows a rear view of the adaptor. In this specific embodiment, the adaptor includes an input or delivery port 210, a platform 215, and a vial port or holder 220. More particularly, in this specific embodiment, the delivery port includes a first side and a second side, opposite the first side. The first side includes an opening 225 to be connected to a fluid source. The fluid can include air. The second side includes a sidewall 230. The platform extends from the sidewall. The vial port is connected to the sidewall and includes a slot 235 for receiving a vial. A portion of the sidewall is absent above the platform.

Figure 4A:
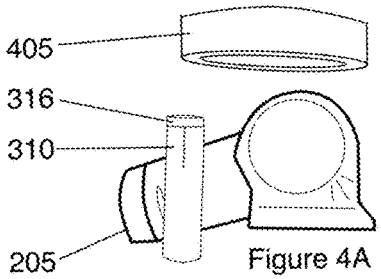
FIGS. 4A-H show a flow for manipulating a sample under humid flow in the adaptor, transferring the sample to a vial and for mounting the sample on the X-ray diffractometer.
Figure 4E:
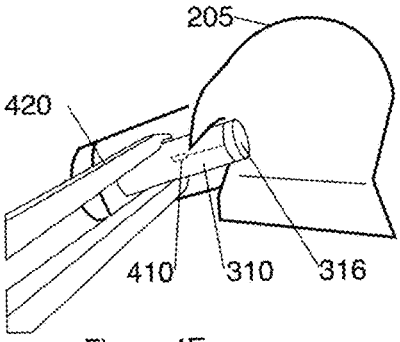
Figure 4B:
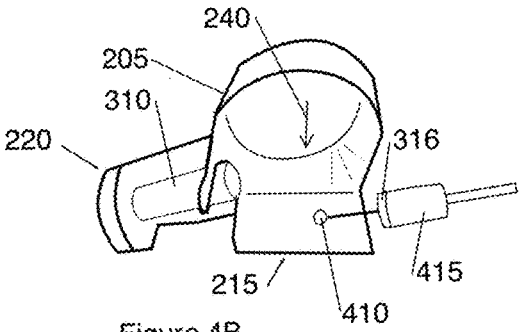

In a specific embodiment, the vial port is at an angle relative to the platform. This helps to allow easier placement of the crystal in the vial than if the vial port is horizontal. In a specific embodiment, the vial port is angled at about 20 degrees. A bottom portion of the vial port may be flattened. The flat part of the vial port provides lateral stability for tips to the left (front view of the adaptor). Lateral stability for tips to the right is provided by using the T for the output port 116 of the humidity controller (visible in FIG. 4A).

Arrows 240 show the direction of humid flow. Key features include: (a) Transparent plastic for easy viewing of the sample (here 2.5 mm (0.1") thick). (b) Input port 225 for humid air (here 4.8 cm (1.9") OD to match output port 116 of humidity controller). (c) Flat platform 215 to hold sample (here 21.6×37.3 mm (0.85×1.47")). (d) Small lip 256 on platform to inhibit escape of humid air (here 2.5 mm (0.10" high)). (e) Tapered transition 280 between input tube and platform for smooth flow of humid air. (f) Cut-away on upper half to permit sample manipulation. (g) Port 220 for holding vial with wide diameter to allow for vial positioning with tweezers. (h) Small depression 270 to receive vial base. (i) Cavity 272 for magnet to facilitate vial positioning. (j) Rounded lip 260, 262 for easy vial entry and exit. In a specific embodiment, a key feature of the system includes an adaptor coupled to the output port of the humidity controller with a flat platform for crystal coverslips (FIG. 2A-B).

In a specific embodiment, there is an adaptor to hold a vial for manipulating a sample under humid airflow. In this specific embodiment, the adaptor includes a body portion 250 and a vial holder portion 220. The body portion includes input port 210 at a first end of the body portion, platform 215 at a second end of the body portion, opposite the first end, a fluid passageway 254 extending from the input port towards the platform, a lip 256 extending from a first edge of the platform, a first sidewall 258 extending from a second edge of the platform, opposite the first edge, where the first sidewall extends at most partially around the fluid passageway, and slot 235 extending from an edge of the first sidewall towards the input port that receives an upper portion of the vial, where the slot includes a U-shape and each of a first set of edges 260 of the slot and a second set of edges 262 of the slot, opposite the first set of edges, is rounded.

In various specific embodiments, the first sidewall extends at most 10, 20, 30, 40, 50, 60, 70, 80, 90, 100, 110, 120, 130, 140, 150, 160, 170, or 180 degrees around the fluid passageway. The first sidewall may extend less than 10 degrees around the fluid passageway. The first sidewall may extend more than 180 degrees around the fluid passageway. Factors to consider in determining the extent to which the first sidewall extends around the fluid passageway include the size or diameter of the vial to be held by the adaptor, desired angle at which the vial is to be held, the desired space with which to manipulate the vial, and the desired amount of covering around the fluid passageway to maintain the humid flow.

In this specific embodiment, the vial holder portion is connected to the first sidewall of the body portion. The vial holder portion includes a base 264 that faces the slot and includes a first side 266, and a second side 268, opposite the first side. The first side includes a first cavity, recess, or depression, or indent 270 that receives a bottom portion of the vial. The second side includes a second cavity 272 (FIG. 2B) that receives a magnet. The magnet may be attached to the adaptor using an adhesive. The magnet imposes a force on the bottom portion of the vial (which may include metal) in a direction from the first side to the second side to removably secure the vial against the base.

For example, the magnet helps to steady the vial as the user rotates the vial to a desired orientation or position within the vial holder. The magnet helps to prevent the vial from slipping or shifting from the desired orientation or position. The vial holder portion further includes a second sidewall 274 extending from the base to the first sidewall. The second sidewall extends at most partially around the base (or at most partially around an interior space of the vial holder that houses a portion of the vial). In various specific embodiments, the second sidewall extends at most 10, 20, 30, 40, 50, 60, 70, 80, 90, 100, 110, 120, 130, 140, 150, 160, 170, or 180 degrees around the base. The second sidewall may extend less than 10 degrees around the interior space of the vial holder. The second sidewall may extend more than 180 degrees around the interior space.

An angle 276 between the platform and an axis 278 passing through the base and the slot is about 20 degrees. A path 240 of the humid airflow is from the input port, through the fluid passageway, past the upper portion of the vial, and above the platform. A transition 280 between the platform and the input port is tapered. For example, a surface between the platform and the input port may slope up from the platform towards the input port. A material of the adaptor includes a transparent plastic. In a specific embodiment, the body and vial holder portions of the adaptor are manufactured as a single piece or as an integrated unit. For example, there can be single mold that includes the body and vial holder portions. In another specific embodiment, the body and vial holder portions may be manufactured as two separate pieces and then joined together such as using an adhesive, plastic welding, or any other suitable joining technique. A material of the adaptor may include plastic, metal, glass, or any other suitable material.

The details of coupling between the humid flow and the adaptor are important for achieving high humidity levels at the adaptor platform 215. FIG. 14A shows an exploded view 1405 of a specific embodiment of this coupling. Flexible silicone tubing 1410 (OD/ID=9.5/6.4 mm (0.375/0.25")) carrying the controllable humid flow is inserted into coupler 1411 (length=42 mm, OD/ID=20/10 mm for upper 28 mm and 20/13 mm for lower 14 mm), which is inserted into coupler 1412 (length=32 mm, OD/ID=33/18 for upper 16 mm and 33/26 mm for 16 mm) which is inserted into coupler 1413, (length=39 mm, OD/ID=47/33 mm for upper 37 mm and 47/27 mm for lower 2 mm) which is inserted into tube/connector 116. The adaptor 205 is also inserted into tube/connector 116; (here length of connector 116=11 cm (4.3"), diameter=4.8 cm (1.9")). After assembly the effect is that the humid air is introduced to the adapter in a stepwise increasing diameter, which is illustrated in a cross-sectional view of the assembled coupling system (FIG. 14B). Combined with the dimensions of the tube/connector 116, the effect is to limit mixing of the humid air with ambient air. If the humid air is at 98 percent, and ambient humidity is 40 percent, then the RH at the adaptor platform was observed to be typically about 95 percent for a flow rate of 10 L/min. More abrupt transitions between the humid air tubing 1410 and the tube/connector 116, and/or shorter lengths of tube/connector 116 increase the humidity drop between the humid air 1410 and the adaptor platform. The sideport of the tube/connector 116 is closed, stabilizing the coupling-adaptor assembly and can help to reduce the humidity drop between the humid air tubing 1410 and the adaptor platform 215.

Figure 14C:
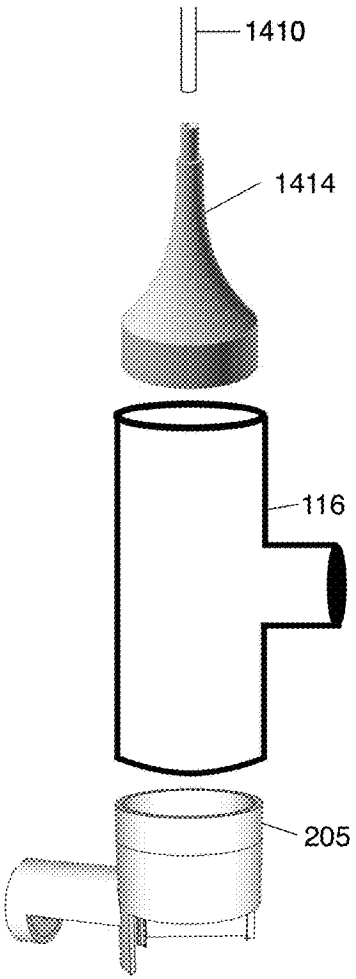
FIG. 14C shows an exploded view of another specific embodiment of a coupling.
Figure 14B:
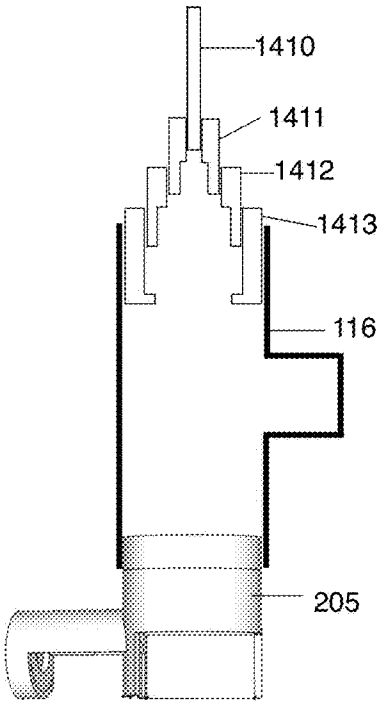
FIG. 14B shows a cross-sectional view of the coupling shown in FIG. 14A.
Figure 14A:
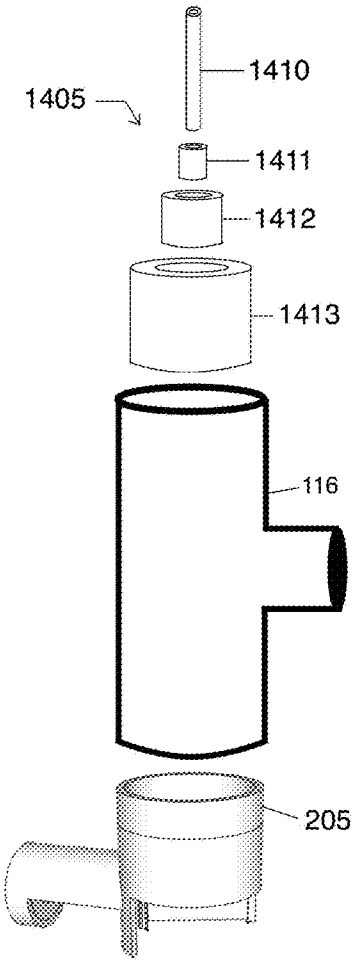
FIG. 14A shows an exploded view of a coupling between an adaptor and a source of humid flow.

FIG. 14 C shows another specific embodiment of the coupling between tubing 1410 and the adaptor 205, Couplers 1411, 1412, and 1413 are replaced by the single coupler 1414. The coupler 1414 includes an upper neck region (length 12.7 mm (0.5"), outer/inner diameter=6.6/4.6 mm (0.26"/0.18") which slips into tubing 1410, a lower neck region (length 12.7 mm (0.5"), outer/inner diameter=48.3/38.1 mm (1.9/1.5")) which slips into tube/connector 116, and a tapered region connecting the two necks (length=43.2 mm (1.7"). In the embodiment of FIG. 14C, the profile of the tapered region is cubic. That is, the diameter varies with the cube of the distance along the tapered region. Other shapes of the taper profile are possible. The effect is to again limit mixing between the humid air and ambient air. Adaptor 205 is attached to the tube/connector 116.

In another specific embodiment of the coupling between tubing 1410 and the adaptor 205, the tube/connector 116 is omitted completely. The tubing 1410 carrying the controllable humid flow is connected to the adaptor 205 directly via the coupler 1414.

To prove operability of adaptor 205, this design was created in Google Sketchup and 3D printed online using transparent resin. With the adaptor in place, a humid flow rate of 10 L/m was found to be sufficient to establish a humid envelope covering the crystal coverslips.

In this specific embodiment, the adaptor also includes a port for vial mounting, with a cavity to hold a small magnet that facilitates positioning the vial in the port (6.4 mm diameter×3.2 mm thick (¼"×⅛")). Other adaptors tailored to different purposes are possible:

(a) Adaptors of similar size and shape to the above, but lacking the vial mounting port. This would provide for more room in the sample handling platform to facilitate mounting processes that do not require transport in a vial. Examples include room temperature mounting of crystals in capillaries or MicroRT tubes (MiTeGen, Ithaca, N.Y. USA) and mounting generic biological samples on microscope slides.

(b) Mobile adaptors. This would include a smaller output port on the humidity control apparatus and an easily moved and positioned adaptor design to deliver humid air to a specified location, providing another approach for manipulating and mounting crystals grown in sitting drops. In some cases, crystals are not easily moved from the growth tray on a coverslip, as in sitting drops, especially with smaller wells in, for example, 96 well plates. One way to manipulate such samples includes having a mobile adaptor. This adaptor is similar to 205 and includes a vial port, but with a smaller output port cross section. The adaptor connects to the humidity controller with flexible tubing, and includes a framework to easily move and position the adaptor in all three cartesian directions, X,Y,Z and to rotate also in three directions, so the output humid flow of the adaptor could be directed in any direction. Wells for sitting drops could then be opened under humid flow, and crystals could be transferred either to well solution sitting on the adaptor platform for soaking in cryosolution and transfer to the vial. Alternatively, the crystals could be transferred directly to a vial for vapor diffusion based cryoprotection. (See below, e.g., paragraphs 72 & 73). Such a system may allow an approach for completely automated crystal harvesting and cryoprotection.

(c) Adaptors designed to hold complete crystallization plates. This would be a different approach for sitting drop plates. The whole plate would be placed in the adaptor, providing a humid envelope for the crystal from the moment the sitting drop well is opened.

Step 2. Sample Mounting in the Vial.

For vial mounting, to prove operability, standard cryovials (obtained from Hampton Research of Aliso Viejo, Calif., USA; and MiTeGen of Ithaca, N.Y., USA) were prepared or modified by plugging the liquid nitrogen escape holes with a small amount of clay or adhesive to prevent diffusion of humid air out of the vial and very lightly greasing the rim of the vial opening. Crystal caps were prepared by placing an O-ring on the cap to rest between the cap and the vial rim, which reduced the evaporation rate of water from the vial when placed at ambient humidity (~40% RH) to about 18 nL/hour, a reduction of ~170 from the rate of 3 μL/hour without the O-ring. At 18 nL/hour, equilibrations can be done for up to several days with less than 1% loss of volume in the vial.

While these steps are effective, modified vials (see, e.g., FIGS. 3A-D) can be provided with one or more of the following physical characteristics:

1) No holes for liquid nitrogen escape.

2) A coating or wrapping which thermally insulates the vial to allow for slower motions in mounting crystals in the cryostream without the cooling of the vapor inside. A test was performed that included wrapping vials in rubber and fiberglass insulation, which increased the allowable time for crystal mounting by several fold.

3) A vial rim constructed to create a vaportight seal between the vial and the crystal cap, eliminating the need for an O-ring. This may include a coating, modified geometry, or both.

Figure 3A:
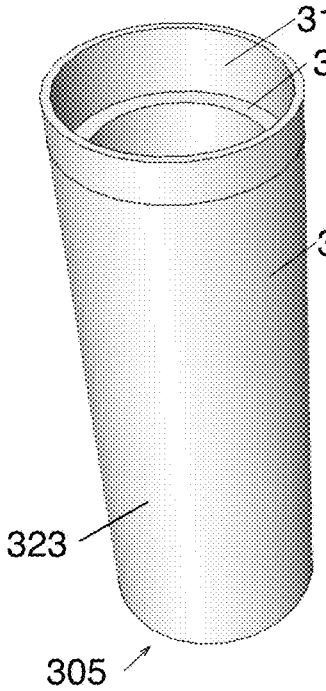
FIG. 3A shows a top view of a first embodiment of a vial.
Figure 3B:
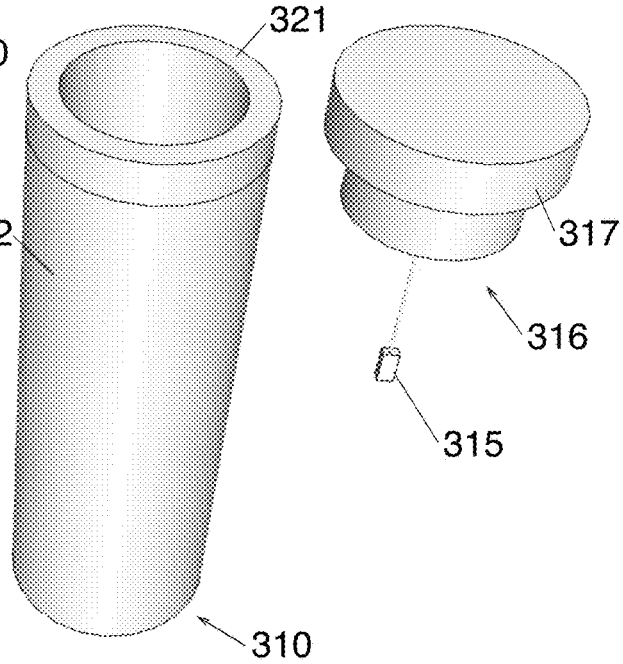
FIG. 3B shows a top view of a second embodiment of a vial.
Figure 3C:
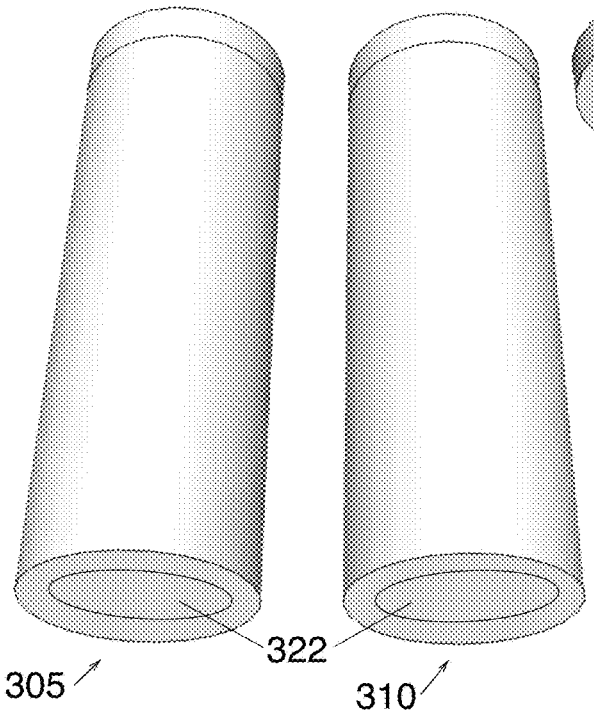
FIG. 3C shows a bottom view of the first embodiment of the vial shown in FIG. 3A.
Figure 3D:
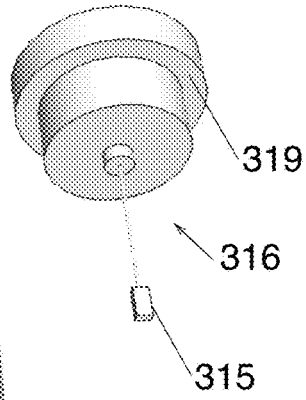
FIG. 3D shows a bottom view of the second embodiment of the vial shown in FIG. 3B.

FIGS. 3A-D show specific embodiments of vials having one or more of the above characteristics. FIG. 3A shows a top view of a first embodiment of a vial 305. FIG. 3C shows a bottom view of the first embodiment of the vial 305 shown in FIG. 3A. FIG. 3B shows a top view of a second embodiment of a vial 310. FIG. 3D shows a bottom view of the second embodiment of the vial 310 shown in FIG. 3B.

In a specific embodiment, the sample 315 is mounted on a commercially available (e.g., Hampton Research) crystal cap 316, which then fits in the vial, with surfaces 317-318 and 319-320 matching (vial 305) or surfaces 319-321 matching (vial 310). The vial design includes at least three primary differences from currently available cryovials for macromolecular crystallography (about 40 mm long with 12.5 mm diameter). These differences are aimed at providing a vaportight seal and a system resistant to heating and cooling. First, there are no liquid nitrogen escape holes (normally there are two 2 mm diameter holes on opposite sides of the side wall 7 mm from the vial opening, which allow liquid nitrogen to escape during cryogenic mounting processes). Second, the vial includes a thermally resistant coating 322 or sleeve 1250 (for sample, silicone or Viton rubber coating or sleeve, or a fiberglass sleeve). Third, the vial rim is coated with a material designed to provide a tight seal between vial and crystal cap. In example of the vial 310 shown in FIGS. 3B and 3D, the cap sits in the vial with surfaces 319-321 providing the seal. In example of the vial shown in FIGS. 3A and 3C, there is additional surface matching 317-318 to improve the seal. Other shapes for surfaces 317-318, 319-320 and 319-321 are possible to improve the vaportight seal. Possible coatings for surfaces 317 & 319 include silicone rubber with or without vacuum grease. The vials contain a metal piece 322 at the bottom of the vial to facilitate positioning in the adaptor 205 with the magnet inserted in depression 272. The crystalcap 316 is held in the vial either by friction or by integrating the standard ring magnet into the vial to provide a magnetic force that pulls the cap down onto the vial.

The vial mounting procedure or flow may then proceed as shown in FIGS. 4A-H. FIGS. 4A-H show various states of a specific embodiment of a vial mounting procedure.

Some specific flows are presented in this application, but it should be understood that the process is not limited to the specific flows and steps presented. For example, a flow may have additional steps (not necessarily described in this application), different steps which replace some of the steps presented, fewer steps or a subset of the steps presented, or steps in a different order than presented, or any combination of these. Further, the steps in other implementations may not be exactly the same as the steps presented and may be modified or altered as appropriate for a particular process, application or based on the data.

In the specific embodiment of a vial mounting procedure illustrated in FIGS. 4A-H, a macromolecular crystal is manipulated, cryoprotecteted and transferred onto an X-ray diffractometer. Cryosolution (500 μL) is pipetted into the vial (e.g. vial 310 in this specific embodiment) and the humid flow is set to the humidity value of the cryosolution predicted by Raoult's Law (Wheeler et al., 2012). Referring now to FIGS. 4A-E, the workflow detail for vial mounting may be as follows: (A) Adaptor 205 in place sitting on the mounting microscope under the microscope lens 405. In this specific embodiment, vial 310, has been fitted with a crystal cap 316, and includes 500 μL of cryosolution, such that the level of the solution is below that of the sample pin of the crystalcap. (B) Under humid flow 240, the vial 310 is placed in the vial holder 220 of adaptor 205, and the sample 410 is placed on the platform 215 of adaptor 205. The sample can then manipulated under the humid flow by using the crystal cap 316 attached to a magnetic wand 415. In this specific embodiment, the sample is a crystal and the manipulation is to transfer the crystal from the growth drop to the cryosolution and soak for ~2 minutes on the platform 215 in humid flow. Other samples and/or other manipulations are possible. (C) After the manipulations, the sample is looped and transferred to the vial 310 using crystalcap 316 attached to a magnetic wand 415. The sample then vapor equilibrates with the solution in the vial. (D) The wand 415 is removed from the crystalcap 316 with a twisting action. (E) The vial 310, with crystalcap 316 with sample 410 attached, is removed from the adaptor with tweezers 420 and placed near the diffractometer (the analytical instrument in this specific embodiment of the vial mounting procedure) in advance of mounting.

After an equilibration period (2 minutes-overnight) the crystal is mounted directly on the diffractometer. (F) The goniometer 425 is position so the crystal will be mounted horizontally and the vial 310 with crystalcap 316 is brought towards the goniometer 425 by hand 430 (shown) or with tweezers. Also shown is the X-ray collimator 435, which carries the X-ray beam, and the cold stream 440, which supports flow of cryogenic liquid nitrogen vapor (typically at 100 K) indicated by arrow 445. (G) Mounting starts with the crystal cap 316 contacting the goniometer 425 and continues as the vial 310 is rotated into place. Although only one hand 430 is shown (for clarity), this can be done with two hands for stability. (H) The vial 310 is removed along the axial axis, leaving the crystal cap 316 on the goniometer 425 with the sample 410 positioned in the cryostream flow 445. A finger from the other hand can be placed on the crystal cap, ensuring that the loop stays in place. It is desirable to limit the total time of the vial in the cold stream (steps G & H) to less than 2 seconds. The exact details of the mounting procedure will depend on factors such as the strength of the magnet on the goniometer head.

Step 3. Transfer of Sample to the Instrument.

Figure 4F:
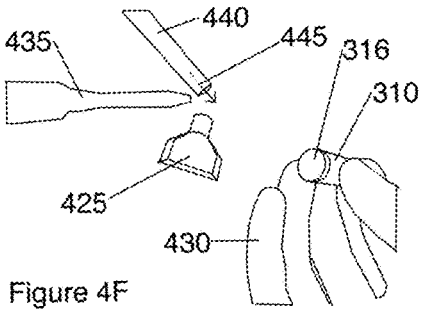
Figure 4C:
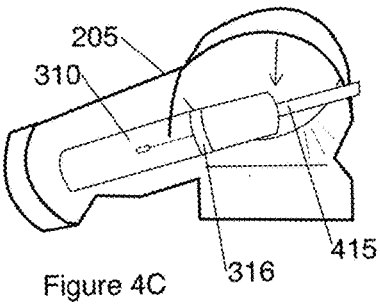
Figure 4G:
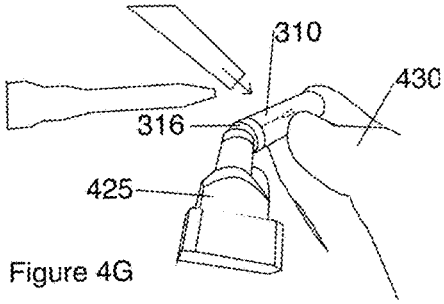
Figure 4D:
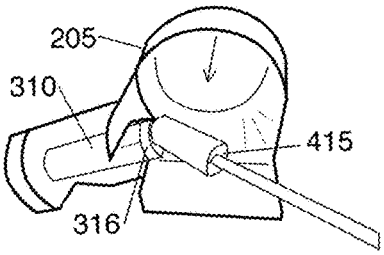
Figure 4H:
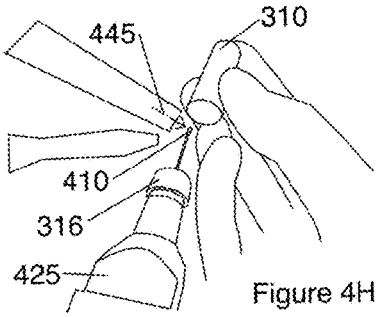

Sample transfer in this case to the cryostream on an X-ray diffractometer may be as shown in FIGS. 4F-H. A sample transfer from the vial directly into a liquid nitrogen dewar has also been successfully executed.

Advantages of the approach. The described approach includes at least three advantages for protein crystallography, which are described in more detail (Farley et al. 2014). In particular:

a) Samples are manipulated at a controllable humidity which is matched to the humidity of the sample. This mitigates damaging dehydration effects than can occur during manipulations of crystals under the microscope. This should be advantageous not only for protein crystallography, but any field in which humidity sensitive samples must be manipulated under a microscope.

b) Dehydration during transit of the sample between the microscope and cooling medium is limited, which improves reproducibility of low temperature cell parameters.

c) Vapor equilibration of the looped crystal in the vial introduces new possibilities for controlled, repeatable protocols in crystallography. Each of the following benefits is demonstrated in (Farley et al., 2014).

i) Cryoprotection via vapor diffusion of volatile cryoprotective agents. This is further demonstrated in (Farley & Juers, 2014b).

ii) Cryoprotection via modest dehydration in which the crystal is equilibrated in vial to a solution of somewhat lower humidity than the crystal soaking solution.

iii) Cryo-annealing in which crystals are demounted from the diffractometer using a vial, equilibrated, and remounted. Cryoannealing is a well-known technique in crystallography, but the use of a vial can improve its reproducibility.

Commercialization possibilities can involve humidity control systems, adaptor(s), vials, and thermally insulated tools (tweezers and wand for manipulating vials and crystal caps).

Figure 5:
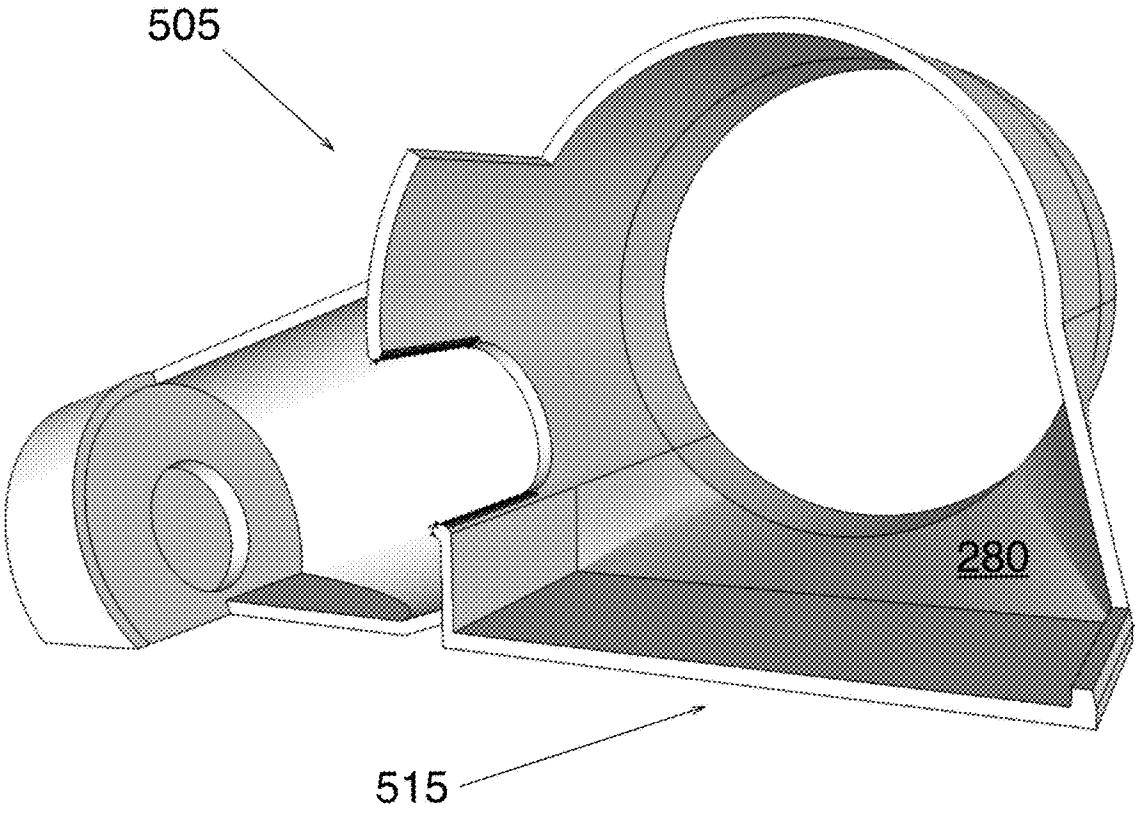
FIG. 5 shows a front view of a second embodiment of an adaptor having a stretched platform.

FIG. 5 shows a front view of another specific embodiment of an adaptor 505 having a stretched platform 515 (22×45 mm). To prove operability, this specific embodiment of the adaptor was also 3D printed as a prototype and tested with good results. The sample platform of this adaptor is a bit larger than the adaptor shown in FIG. 2A to accommodate two full sized crystal coverslips. In other words, this adaptor is similar to adaptor 205 but includes a wider sample platform 215 that can accommodate two standard 22 mm crystal coverslips. The taper 280 now extends to the right as well as down.

Figure 6:
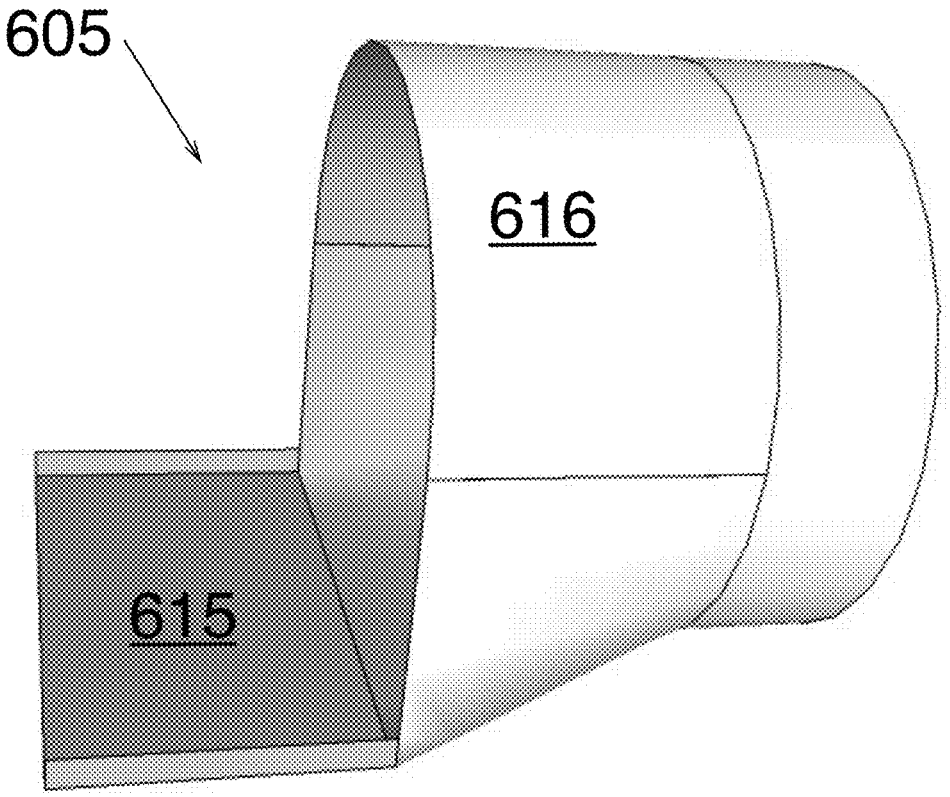
FIG. 6 shows a front view of a third embodiment of an adaptor having no vial port.

FIG. 6 shows a front view of another specific embodiment of an adaptor 605 having no vial port. This adaptor can be used just for sample manipulation that may include mounting on a microscope slide, but no transfer to the vial. This adaptor is similar to adaptor 205 but without the vial port. The sample platform 615 is therefore wider (25 mm×48 mm). This adaptor could be used for applications not requiring vial mounting—such as mounting of macromolecular crystals in capillaries or MicroRT tubes, or non-crystallography applications requiring sample manipulations at controllable humidities.

Figure 7:
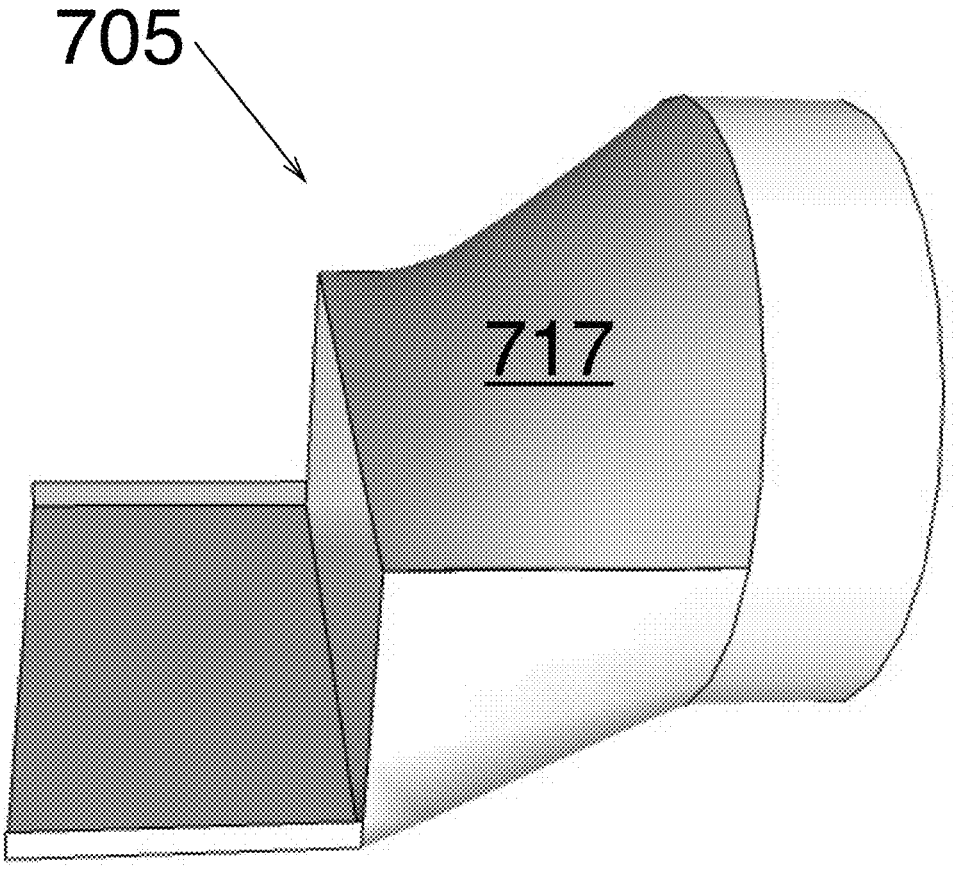
FIG. 7 shows a front view of a fourth embodiment of an adaptor having no vial port and having a taper.

FIG. 7 shows a front view of another specific embodiment of an adaptor 705 having no vial port and having a taper. This adaptor is similar to the adaptor shown in FIG. 6, but includes a tapered humidity delivery port that may improve the humid flow. A taper 717 on the upper half connects the round input port to the smaller, rectangular output port (24.1×48.2 mm). This contrasts with the straight upper half 616 of adaptor 605. The reduction in cross sectional area increases the velocity of the output humid flow, improving the extent of the humid envelope.

Figure 8:
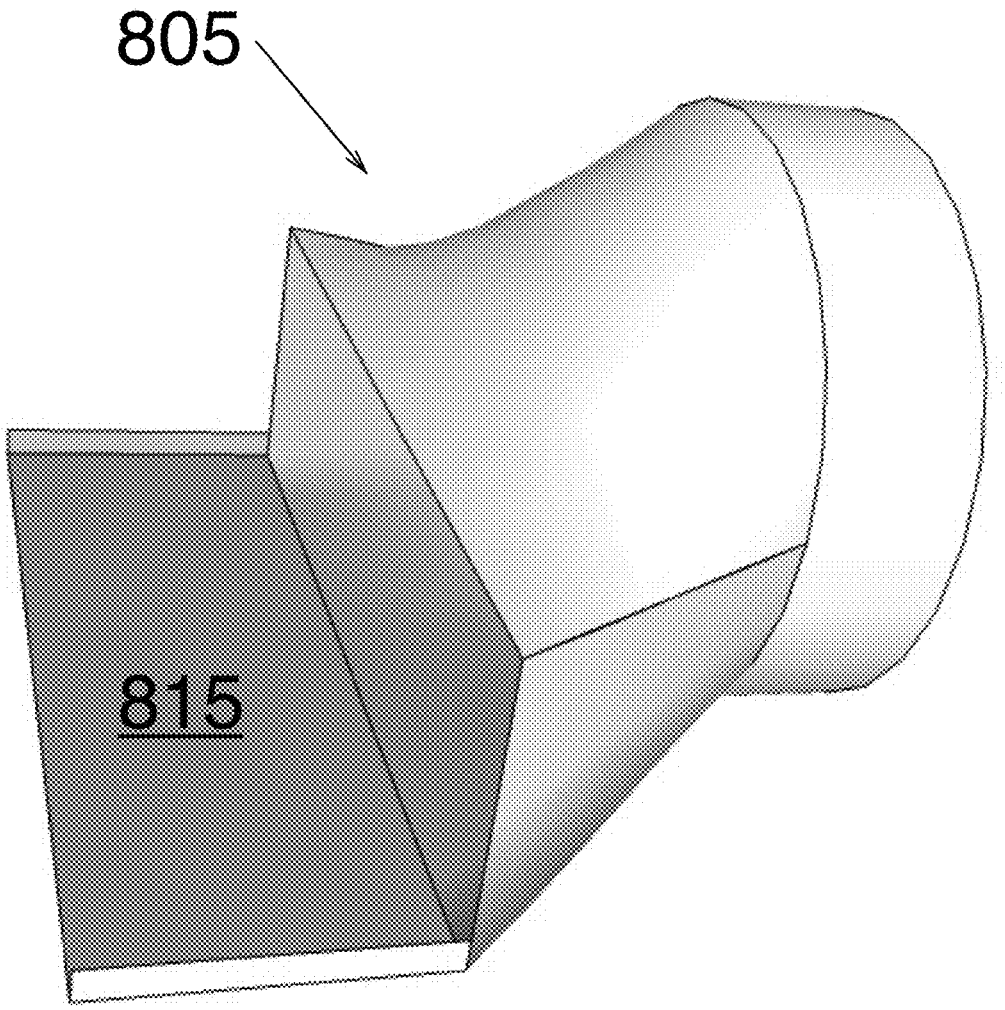
FIG. 8 shows a front view of a fifth embodiment of an adaptor having no vial port and having an extended platform.

FIG. 8 shows a front view of another specific embodiment of an adaptor 805 that is without a vial port and includes an extended platform. This adaptor is similar to the adaptor shown in FIG. 7, but with a wider platform 815 (25 mm×80 mm (1"×3.2"). This platform will accommodate a standard microscope slide (25 mm×75 mm (1"×3")) and could be used to prepare a typical biological sample under controlled humidity conditions.

Figure 9:
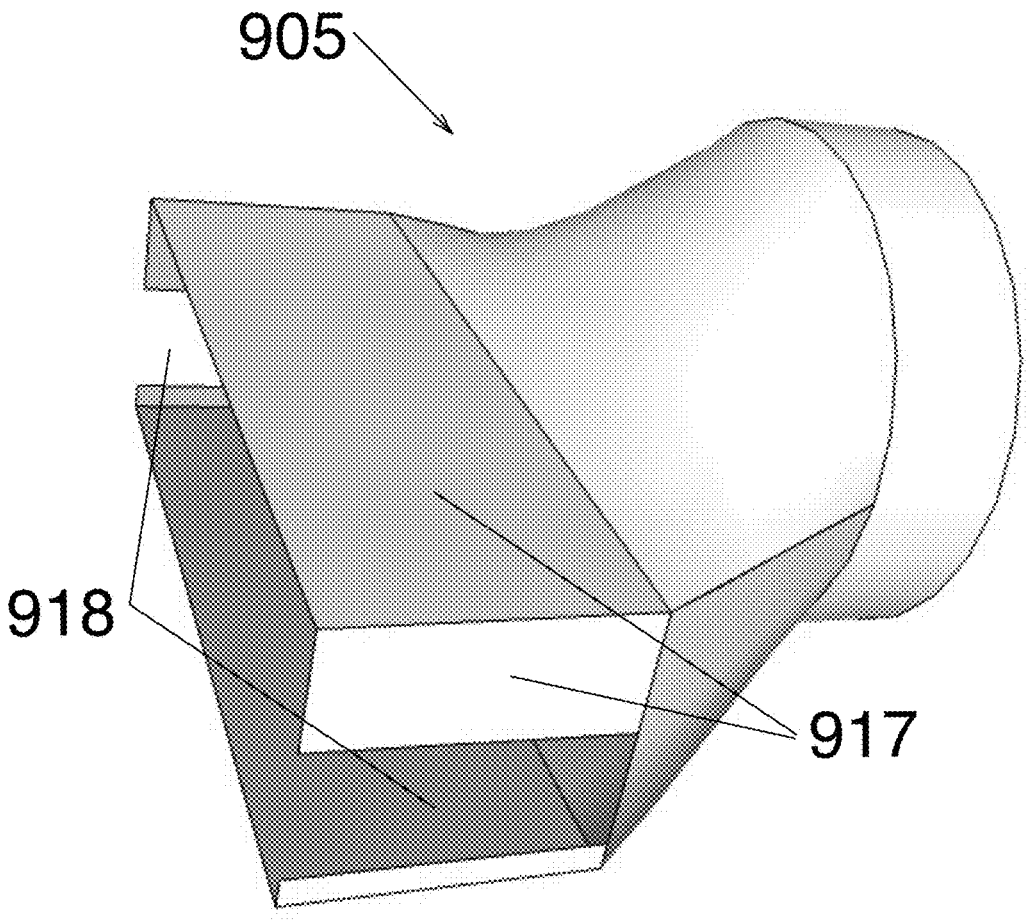
FIG. 9 shows a front view of a sixth embodiment of an adaptor having no vial port and having a taper and window.

FIG. 9 shows a front view of another specific embodiment of an adaptor 905 having no vial port and having a taper and window. In this specific embodiment, the adaptor is without a vial port and includes an extended platform and shroud. This adaptor is similar to the adaptor shown in FIG. 7, but with the top opening covered, to further improve humid flow (while sacrificing some flexibility in sample manipulation). That is, this adaptor includes a shroud, or cowling 917, to improve the humid flow or envelope. Manipulation of the sample from the side is possible through the side windows 918. Using transparent plastic allows visualization of the sample in the microscope.

Figure 10A:
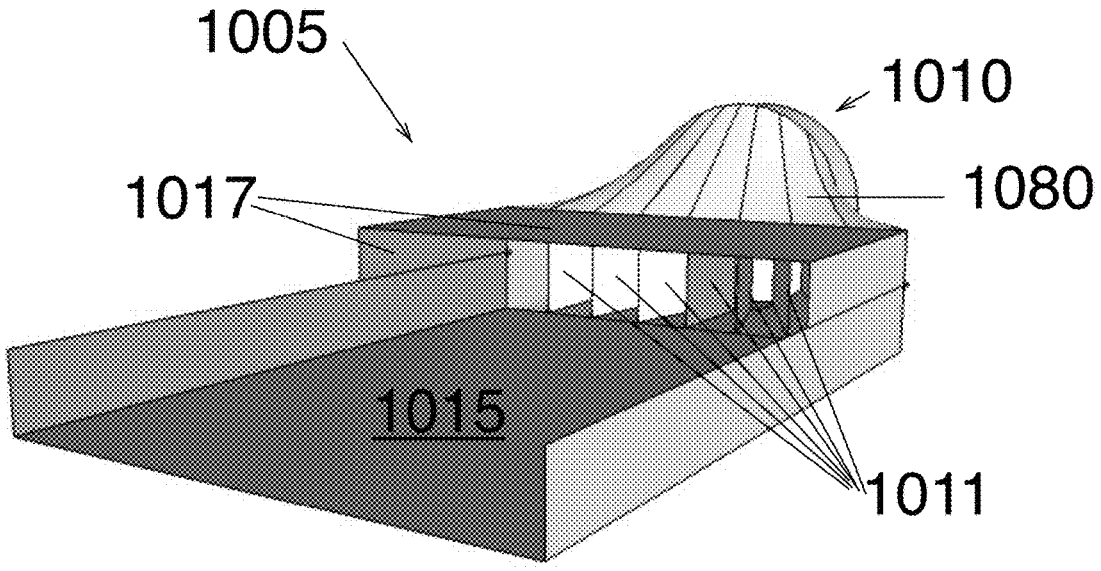
FIG. 10A shows a front view of a seventh embodiment of an adaptor for plates with sitting drops.
Figure 10B:
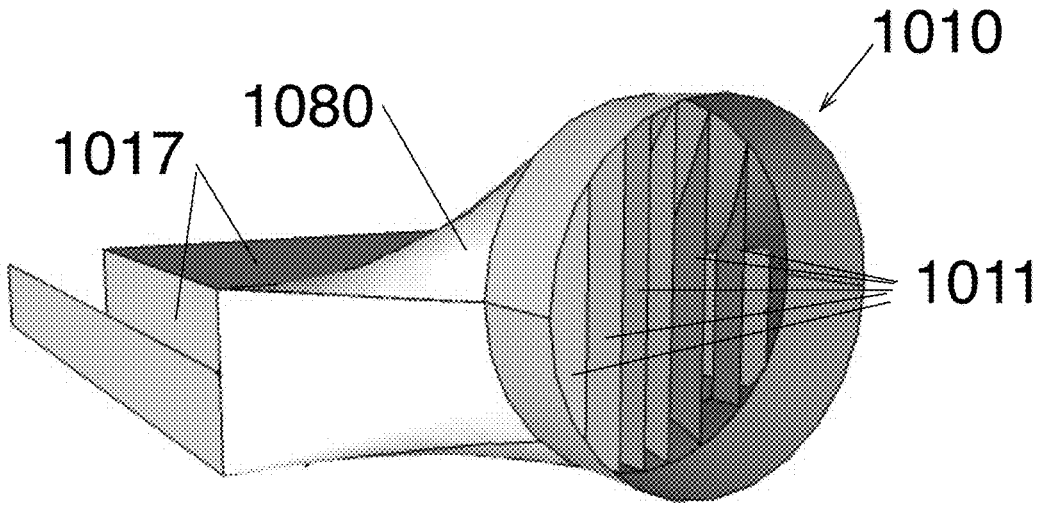
FIG. 10B shows a rear view of the adaptor shown in FIG. 10A.

FIGS. 10A-B show front and rear views, respectively, of another specific embodiment of an adaptor 1005 for plates with sitting drops. The input port 1010 connects with a taper 1080 to a larger output port to handle whole crystallization plates. Baffles 1011 ensure delivery of humid air to the outside edges of the output port. The sample platform 1015 is the size the crystallization plate (here about 12.7 cm×8.9 cm or 5"×3.5" for a 96 well plate), and includes sidewalls the height of the plate (here 1.3 cm or 0.5" for a 96 well plate). The shroud 1017—6.4 cm×8.9 cm or 2.5"×3.5" for a 96 well plate) covers about half of the plate to permit positioning any well on the plate just adjacent to the mouth of the shroud and therefore within the humid envelope. Crystals may be manipulated and transferred to a coverslip with cryosolution sitting on the plate all within the humid envelope. The coverslip could then be transferred to the adaptor 205 for vial mounting.

Figure 11:
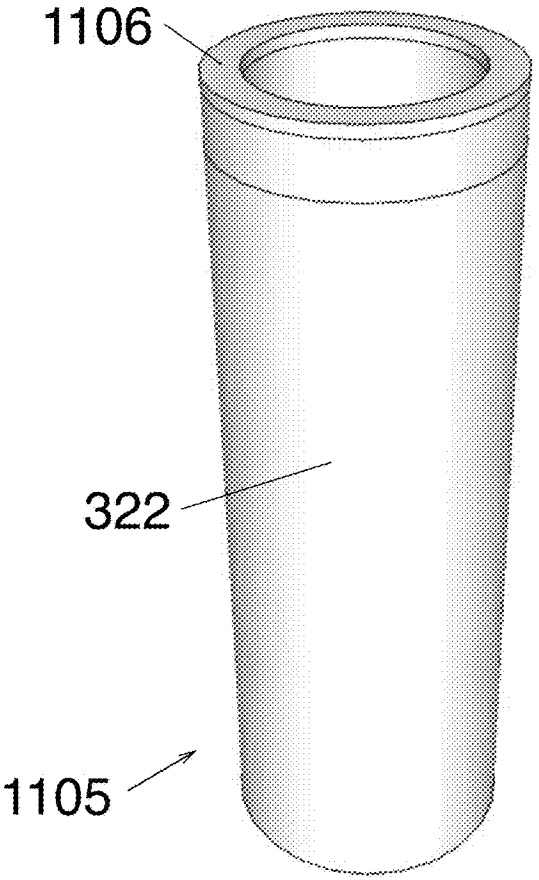
FIG. 11 shows another example of a vial in specific embodiment.

FIG. 11 shows another specific embodiment of a vial 1105. This vial includes a thermal coat 322, but lacks the vaportight rim coat. Instead, the vaportight seal is achieved with a gasket 1106 attached to the vial.

Figure 12B:
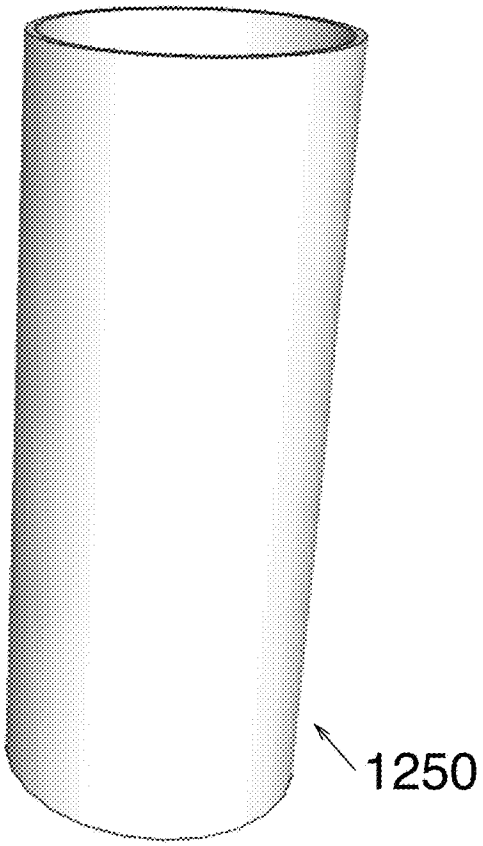
FIG. 12B shows an example of thermal barrier sleeve that may be placed over the vial shown in FIG. 12A.
Figure 12A:
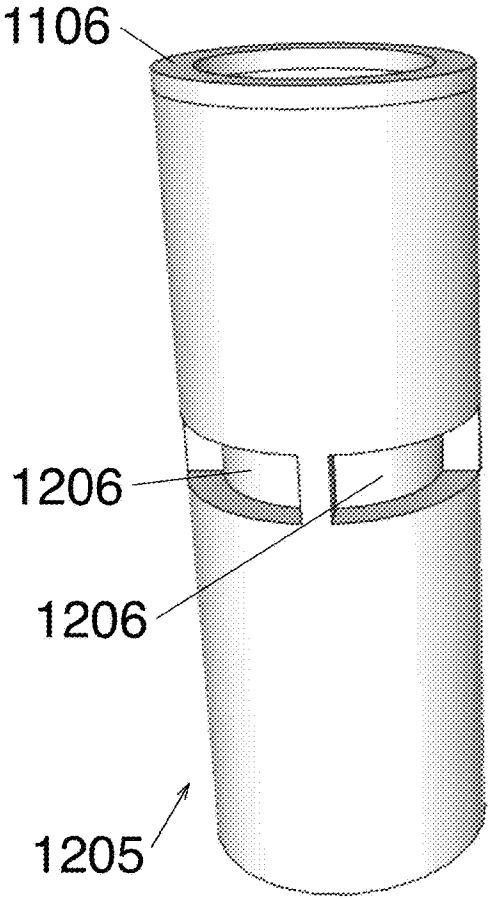
FIG. 12A shows another example of a vial in a specific embodiment.

FIG. 12A shows another specific embodiment of a vial 1205 for room temperature crystal characterization. The vial includes a gasket 1106 for a vaportight seal with the crystal cap. The vial includes four windows 1206 made of thin, X-ray transparent, polyimide film, located so the crystal can be exposed to X-rays through the windows when the crystal cap is in place. This allows for enough X-ray data to be collected at room temperature for unit cell and crystal quality characterization. There can be any number of windows. FIG. 12B shows a thin thermal barrier sleeve 1250

(rubber, fiberglass insulation 1-2 mm thick) that can be placed over the vial for vial mounting on the cryostream.

Figure 13B:
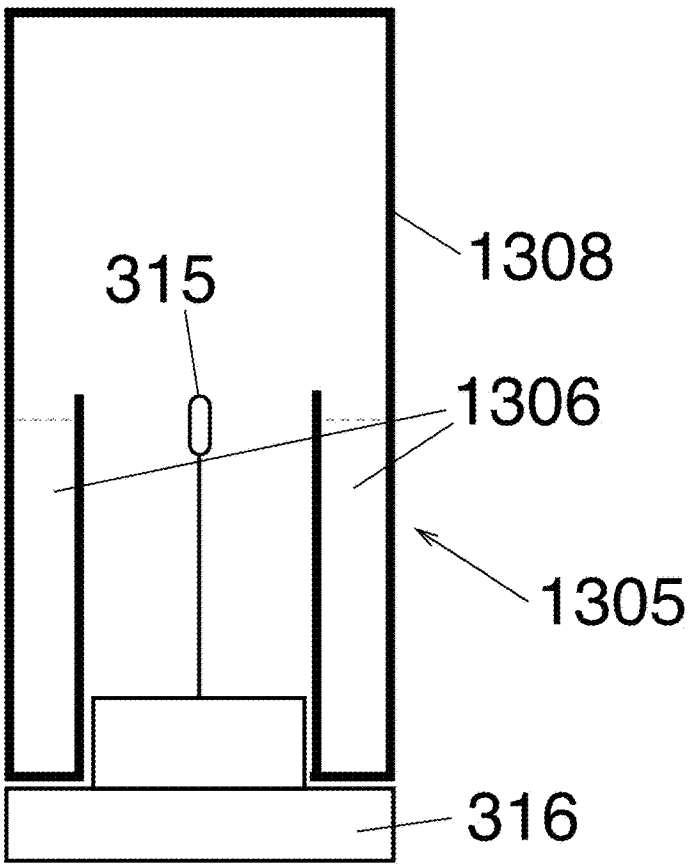
FIG. 13B shows an example of the vial shown in FIG. 13A in a second position.
Figure 13A:
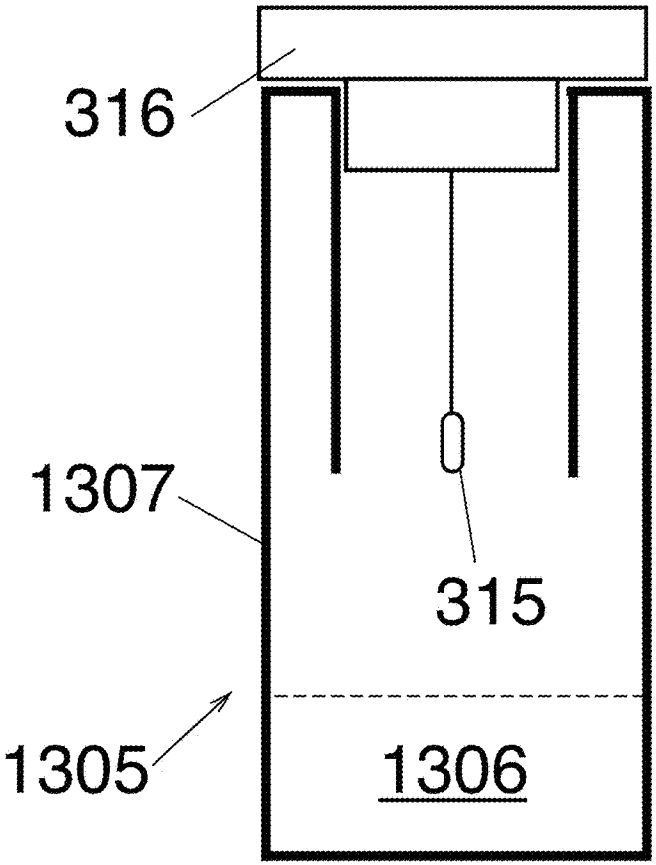
FIG. 13A shows another example of a vial having a tapered reservoir in a first position in a specific embodiment.

FIGS. 13A-B show a cross-sectional view of another specific embodiment of a vial 1305 with annular reservoir allowing for "right-side up" manipulation. Left (FIG. 13A)—"Upside-down" vial configuration 1307 with crystal cap 316 and sample 315 in place. The vial contains buffer solution 1306 collecting in the bottom of the vial in vapor equilibrium with the sample. Right (FIG. 13B)—the same vial after turning "right-side up." With the vial in right side up configuration 1308, the buffer solution collects in the annular reservoir, leaving the crystal intact and permitting the vial to be mounted on the diffractometer in this upright position. This type of vial will be useful for vial mounting on diffractometers with a simple goniometer fixed in the vertical orientation.

It should be appreciated that an adaptor may have any combination of features discussed. For example, another specific embodiment of an adaptor may include a stretched platform and no vial port. As yet another example, another specific embodiment of an adaptor may include a stretched platform, a vial port, and a window or covered top opening.

It should also be appreciated that a vial may have any combination of features discussed. For example, another specific embodiment of a vial may include an annual reservoir combined with windows for room temperature data collection.

Figure 15:
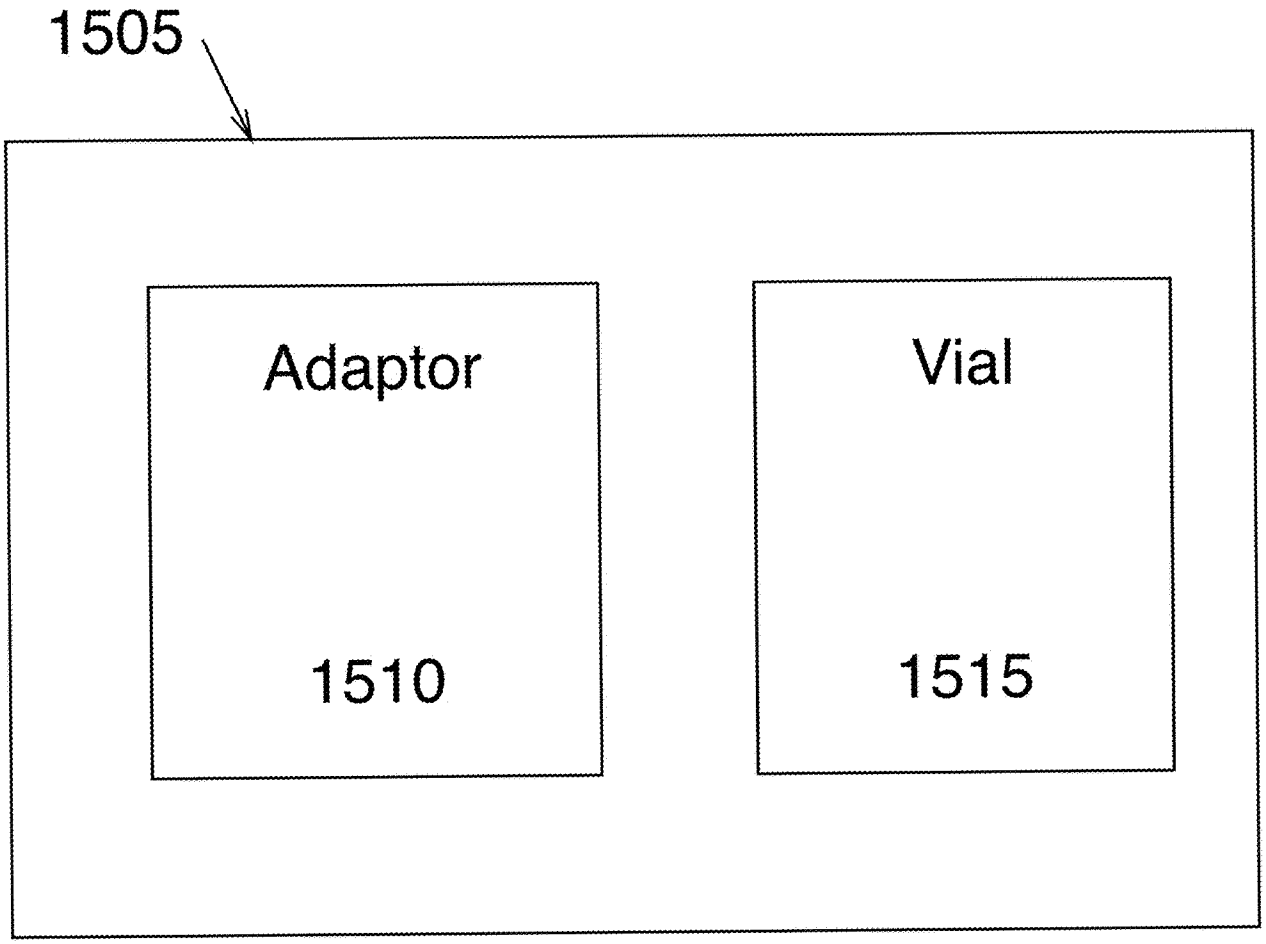
FIG. 15 shows an example of a kit having an adaptor and a vial.

FIG. 15 shows an example of a kit 1505 having a container or tray that includes one or more adaptors as described, one or more vials as described, one or more couplings as described, or combinations of these. For example, a kit may include an adaptor and a vial. A kit may include two or more adaptors. There can be adaptors of different types, adaptors of the same types, or both. A kit may include two or more vials. There can be vials of different types, vials of the same types, or both.

In a specific embodiment, there is a kit including an adaptor device to hold a vial including a body portion including an input port at a first end of the body portion, a platform at a second end of the body portion, opposite the first end, a fluid passageway extending from the input port towards the platform, a lip extending from a first edge of the platform, a first sidewall extending from a second edge of the platform, opposite the first edge, where the first sidewall extends at most partially around the fluid passageway, and a slot extending from an edge of the first sidewall towards the input port that receives an upper portion of the vial, where the slot comprises a U-shape and each of a first set of edges of the slot and a second set of edges of the slot, opposite the first set of edges, is rounded, and a vial holder portion, coupled to the first sidewall of the body portion, the vial holder portion including a base, facing the slot, and comprising a first side, and a second side, opposite the first side, the first side comprising a first cavity that receives a bottom portion of the vial, and the second side comprising a second cavity that receives a magnet, where the magnet imposes a force on the bottom portion of the vial in a direction from the first side to the second side to removably secure the vial against the base, and a second sidewall extending from the base to the first sidewall, where the second sidewall extends at most partially around the base, and a vial to be received by the vial holder portion including a vial body, at least one of a thermally resistant coating or sleeve around the vial body, a cap coupled to an end of the vial body to hold the sample, and a metal coupled to an opposite end of the vial body to pull the vial towards the magnet.

In the description above and throughout, numerous specific details are set forth in order to provide a thorough understanding of an embodiment of this disclosure. It will be evident, however, to one of ordinary skill in the art, that an embodiment may be practiced without these specific details. In other instances, well-known structures and devices are shown in block diagram form to facilitate explanation. The description of the preferred embodiments is not intended to limit the scope of the claims appended hereto. Further, in the methods disclosed herein, various steps are disclosed illustrating some of the functions of an embodiment. These steps are merely examples, and are not meant to be limiting in any way. Other steps and functions may be contemplated without departing from this disclosure or the scope of an embodiment.

What is claimed is:

1. An adaptor device to hold a vial comprising:
- a body portion comprising:
  - an input port at a first end of the body portion;
  - a platform at a second end of the body portion, opposite the first end;
  - a fluid passageway extending from the input port towards the platform;
  - a lip extending from a first edge of the platform;
  - a first sidewall extending from a second edge of the platform, opposite the first edge, wherein the first sidewall extends at most partially around the fluid passageway; and
  - a slot extending from an edge of the first sidewall towards the input port that receives an upper portion of the vial, wherein the slot comprises a U-shape and each of a first set of edges of the slot and a second set of edges of the slot, opposite the first set of edges, is rounded; and
- a vial holder portion, coupled to the first sidewall of the body portion, the vial holder portion comprising:
  - a base, facing the slot, and comprising a first side, and a second side, opposite the first side, the first side comprising a first cavity that receives a bottom portion of the vial, and the second side comprising a second cavity that receives a magnet, wherein the magnet imposes a force on the bottom portion of the vial in a direction from the first side to the second side to removably secure the vial against the base; and
  - a second sidewall extending from the base to the first sidewall, wherein the second sidewall extends at most partially around the base.

2. The adaptor of claim 1 wherein an angle between the platform and an axis passing through the base and the slot is about 20 degrees.

3. The adaptor of claim 1 wherein a path of a humid airflow is from the input port, through the fluid passageway, past the upper portion of the vial, and above the platform.

4. The adaptor of claim 1 wherein a transition between the platform and the input port is tapered.

5. The adaptor of claim 1 wherein a material of the adaptor comprises a transparent plastic.

6. The adaptor of claim 1 comprising the magnet, wherein the magnet is coupled within the second cavity by an adhesive.

7. A kit comprising:
- an adaptor device to hold a vial comprising:
  - a body portion comprising:
    - an input port at a first end of the body portion;
    - a platform at a second end of the body portion, opposite the first end;

a fluid passageway extending from the input port towards the platform;

a lip extending from a first edge of the platform;

a first sidewall extending from a second edge of the platform, opposite the first edge, wherein the first sidewall extends at most partially around the fluid passageway; and a slot extending from an edge of the first sidewall towards the input port that receives an upper portion of the vial, wherein the slot comprises a U-shape and each of a first set of edges of the slot and a second set of edges of the slot, opposite the first set of edges, is rounded; and a vial holder portion, coupled to the first sidewall of the body portion, the vial holder portion comprising:

a base, facing the slot, and comprising a first side, and a second side, opposite the first side, the first side comprising a first cavity that receives a bottom portion of the vial, and the second side comprising a second cavity that receives a magnet, wherein the magnet imposes a force on the bottom portion of the vial in a direction from the first side to the second side to removably secure the vial against the base; and a second sidewall extending from the base to the first sidewall, wherein the second sidewall extends at most partially around the base; and a vial to be received by the vial holder portion comprising:

a vial body;

at least one of a thermally resistant coating or sleeve around the vial body;

a cap coupled to an end of the vial body to hold a sample; and a metal coupled to an opposite end of the vial body to pull the vial towards the magnet.

8. The kit of claim 7 wherein an angle between the platform and an axis passing through the base and the slot is about 20 degrees.

9. The kit of claim 7 wherein a path of a humid airflow is from the input port, through the fluid passageway, past the upper portion of the vial, and above the platform.

10. The kit of claim 7 wherein a transition between the platform and the input port is tapered.

11. The kit of claim 7 wherein a material of the adaptor comprises a transparent plastic.

* * * * *